US011808180B1

(12) United States Patent
Adams et al.

(10) Patent No.: US 11,808,180 B1
(45) Date of Patent: Nov. 7, 2023

(54) VALVE ACTUATION SYSTEM HAVING LIFTER SLEEVES CONFIGURED FOR CONTROL FLUID COMMUNICATION WITH VALVE LIFTER ACTIVATION-DEACTIVATION SWITCHES

(71) Applicant: Caterpillar Inc., Peoria, IL (US)

(72) Inventors: Jeremy C. Adams, Rapid City, SD (US); Eric D. Wiebrecht, Germantown Hills, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 18/114,466

(22) Filed: Feb. 27, 2023

(51) Int. Cl.
*F01L 13/00* (2006.01)
*F01L 1/24* (2006.01)

(52) U.S. Cl.
CPC ..... *F01L 13/0005* (2013.01); *F01L 1/2411* (2013.01); *F01L 2013/001* (2013.01); *F01L 2305/00* (2020.05)

(58) Field of Classification Search
CPC ..... F01L 5/00
USPC ..... 123/188.1, 188.5, 198 F, 179.16, 90.16
See application file for complete search history.

(56) References Cited

U.S. PATENT DOCUMENTS

| | | | |
|---|---|---|---|
| 4,050,435 | A | 9/1977 | Fuller, Jr. |
| 4,414,935 | A | 11/1983 | Curtis et al. |
| 6,584,951 | B1 | 7/2003 | Patel et al. |
| 6,681,734 | B2 | 1/2004 | Albertson |
| 6,976,463 | B2 | 12/2005 | Spath et al. |
| 7,121,244 | B2 | 10/2006 | Roe et al. |
| 8,316,809 | B1 | 11/2012 | Patterson et al. |
| 10,619,525 | B2 | 4/2020 | McCarthy, Jr. et al. |
| 10,968,788 | B2 | 4/2021 | McCarthy, Jr. et al. |
| 2004/0244744 | A1 | 12/2004 | Falkowski et al. |

*Primary Examiner* — John Kwon
(74) *Attorney, Agent, or Firm* — Brannon Sowers & Cracraft PC

(57) ABSTRACT

An engine valve actuation system includes a lifter sleeve having a control fluid slot formed therein and extending from an outer sleeve surface to an inner sleeve surface. A valve lifter is movable in a sleeve bore in the lifter sleeve and limited from rotation about a longitudinal axis. The valve lifter includes a hydraulically actuated activation-deactivation switch, and a control fluid port in continuous fluid communication with the control fluid slot.

20 Claims, 4 Drawing Sheets

VALVE ACTUATION SYSTEM HAVING LIFTER SLEEVES CONFIGURED FOR CONTROL FLUID COMMUNICATION WITH VALVE LIFTER ACTIVATION-DEACTIVATION SWITCHES

TECHNICAL FIELD

The present disclosure relates generally to an engine valve actuation system, and more particularly to controlling engine valve activation and deactivation by way of a control fluid communicated to a valve lifter through a control fluid slot in a lifter sleeve.

BACKGROUND

Valve actuation systems are well-known and widely used in internal combustion engine systems, and a multitude of designs have been used for over a century. A typical engine valve actuation system can include a rotating cam coupled to the engine gear train that interacts with valve lifters to reciprocate rocker arms connected to engine valves including intake valves and exhaust valves. General principles relating to rapidly and reliably opening and closing intake and exhaust valves at appropriate engine timings are well established.

In some instances, it can be desirable to vary opening or closing timings of intake or exhaust valves in the engine. Still other applications seek to halt valve actuation altogether for periods of time. In the latter case intake valves and exhaust valves may be deactivated entirely causing pistons in deactivated cylinders to operate as air springs. Cylinder deactivation strategies for purposes of controlling exhaust temperatures, diagnosing operation of certain cylinders, and for other purposes, have been used for many years. U.S. Pat. No. 4,050,435 to Fuller, Jr. et al. is directed to a valve control for cylinder cutout system. In Fuller, Jr. et al., selective deactivation of valve operation can be effected by uncoupling a pushrod and its respective valve. Engine oil pressure is apparently used as the operating fluid of the cutout device. The art provides ample room for improvements and development of alternative strategies.

SUMMARY OF THE INVENTION

In one aspect, an engine valve actuation system includes a lifter sleeve defining a longitudinal axis and positionable in a lifter bore in an engine housing. The lifter sleeve includes an inner sleeve surface extending circumferentially around the longitudinal axis and forming a sleeve bore extending between a first axial end opening and a second axial end opening, and an outer sleeve surface extending circumferentially around the longitudinal axis. The lifter sleeve further includes a control fluid slot formed therein and extending radially inward from the outer sleeve surface to the inner sleeve surface. The system further includes a valve lifter movable in an axial direction in the sleeve bore between a first position and a second position, and limited from rotating about the longitudinal axis. The valve lifter includes a pushrod seat, a lifter roller, a hydraulically actuated activation-deactivation switch, and a control fluid port fluidly connected to the control fluid slot at each of the first position and the second position.

In another aspect, a lifter sleeve for a valve lifter in an engine system includes an elongate sleeve body defining a longitudinal axis extending between an upper sleeve section forming a first axial end opening, and a lower sleeve section forming a second axial end opening. The elongate sleeve body further includes an inner sleeve surface extending circumferentially around the longitudinal axis and forming a sleeve bore extending from the first axial end opening to the second axial end opening, and an outer sleeve surface extending circumferentially around the longitudinal axis. The elongate sleeve body further includes a fluid flow annulus extending circumferentially around the longitudinal axis at a location between the upper sleeve section and the lower sleeve section, and a control fluid slot extending from the outer sleeve surface to the inner sleeve surface. The upper sleeve section further includes threads, and a valve lifter anti-rotation surface within the sleeve bore and positioned axially inward of the threads.

In still another aspect, a method of operating an engine valve actuation system includes reciprocating a plurality of valve lifters between a first position and a second position in a plurality of lifter sleeves in a plurality of lifter bores in an engine housing, and fluidly connecting a control fluid port in each one of the plurality of valve lifters to a control fluid slot formed in each respective one of the plurality of lifter sleeves at each of the first position and the second position. The method further includes varying a pressure of a control fluid supplied through the engine housing to the control fluid slot in at least one of the plurality of lifter sleeves, and switching a hydraulically actuated activation-deactivation switch in the valve lifter in the at least one of the plurality of lifter sleeves between an activated state and a deactivated state based on the varying a pressure of a control fluid.

DETAILED DESCRIPTION

Figure 1:
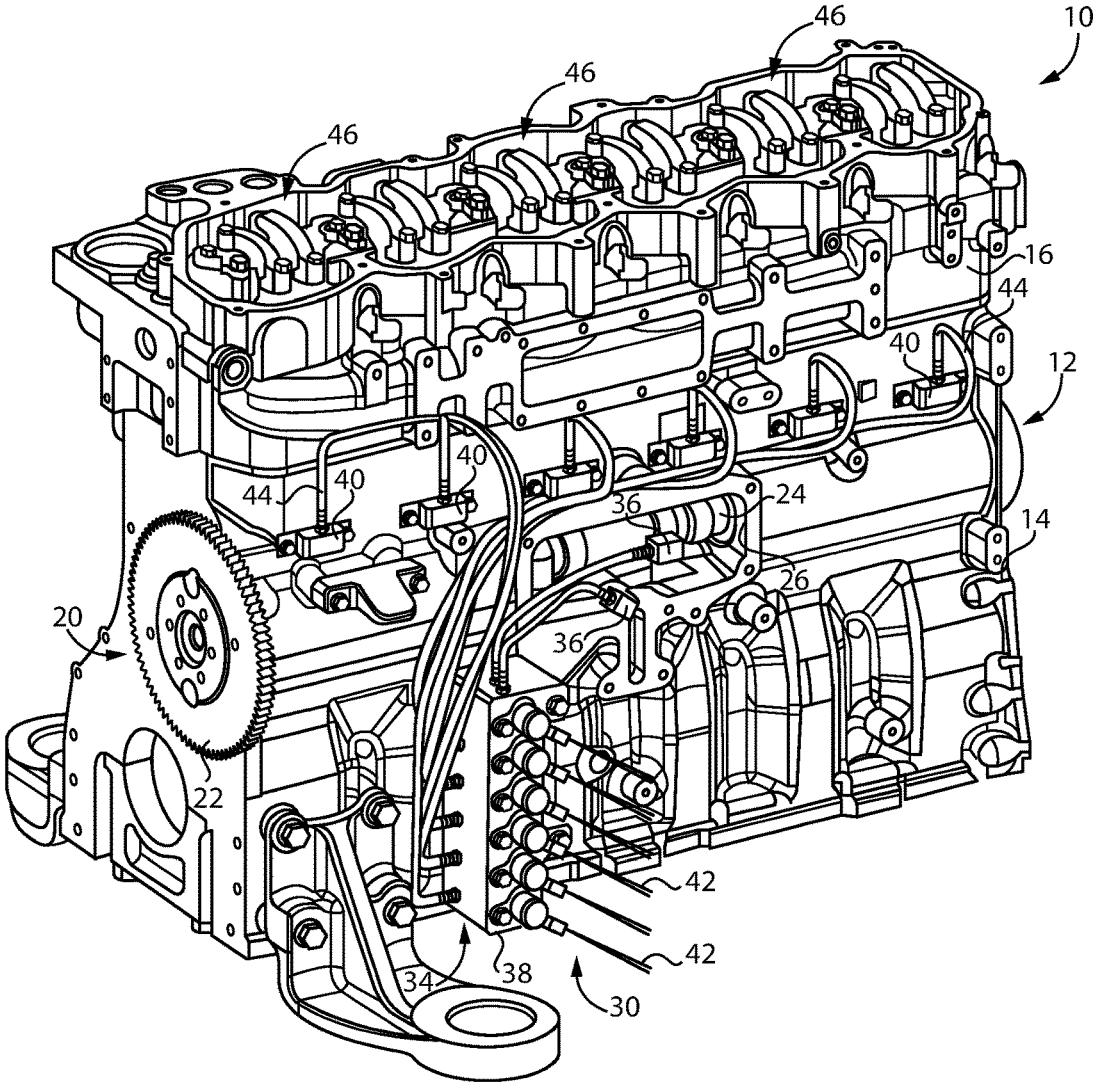
FIG. 1 is a diagrammatic view of an engine system, according to one embodiment.

Referring to FIG. 1, there is shown a machine system 10 according to one embodiment. In a practical implementation, machine system 10 includes an engine system (hereinafter "engine system 10") having an internal combustion engine 12. Engine 12 includes an engine housing 14 having a cylinder block 16, and an engine head 18 attached to cylinder block 16. Engine 12 also includes a gear train 20 including a cam gear 22 rotatable in a generally conventional manner to rotate a camshaft 24. Camshaft 24 rotates within an oil gallery 26. Engine 12 may include a compression-ignition diesel engine operable on a diesel distillate fuel, for example. A plurality of cylinders and a plurality of pistons (not shown) are positioned in engine housing 14. It will be appreciated that in the illustrated embodiment engine 12 would be understood to include six cylinders in an in-line arrangement. In other implementations engine 12 could include a different number of cylinders, in any suitable arrangement such as a V-pattern or still another. Engine 12 could also be spark-ignited rather than compression-ignited, operable on a different fuel type such as gasoline or natural gas, as well as various blends. Engine system 10 could be used in an electrical power generation application, to power a pump or a compressor, or to operate a driveline in a land vehicle or a marine vessel to name a few examples. Engine system 10 also include an engine valve actuation system 30 for operating intake valves and exhaust valves associated with the respective cylinders. As will be further apparent from the following description, engine system 10 is configured for improved performance and advantageous engine construction by way of the design and components of valve actuation system 30.

Engine valve actuation system 30 (hereinafter "system 30") may include a hydraulic system 34. Hydraulic system 34 may include one or more fluid connectors 36 positioned to fluidly connect to oil gallery 26. Hydraulic system 34 may further include a manifold assembly 38, and a plurality of lifter manifolds 40. A plurality of electrical lines 42 connect to manifold assembly 38 for energizing and controlling electrical actuators therein as further discussed below. Fluid lines 44 connect between manifold assembly 38 and lifter manifolds 40. As also further discussed herein lifter manifolds 40 may be configured to fluidly connect manifold assembly 38 to a plurality of valve lifters positioned in engine housing 14 and operable to actuate a plurality of rocker arm assemblies 46. Rocker arm assemblies 46, hereinafter referred to at times in the singular, may each be structured to reciprocate in a generally conventional manner to open and close intake valves or exhaust valves each associated with one of the cylinders in engine 12.

Figure 2:
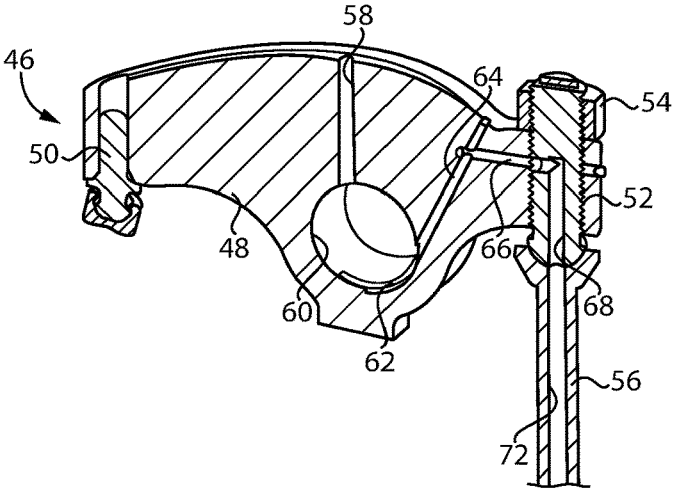
FIG. 2 is a sectioned diagrammatic view of a rocker arm assembly, according to one embodiment.

Referring also now to FIG. 2, there is shown rocker arm assembly 46 in greater detail. Rocker arm assembly 46 includes a rocker arm 48 having a bore 60 formed therein for supporting a rocker shaft upon which rocker arm 48 reciprocates. Rocker arm assembly 46 also includes a valve pin 50 that couples to one or more engine valves, in an example embodiment two exhaust valves or two intake valves connected by way of a valve bridge. Rocker arm assembly 46 also includes a stud 54 threaded engaged in rocker arm 48, and a lash adjustment nut 54 threaded engaged with stud 52. Stud 52 is coupled to a pushrod 56. Pushrod 56 is in turn coupled to a valve lifter in system 30, as further discussed herein.

As can also be seen from FIG. 2, rocker arm 48 has formed therein an incoming oil passage 58 that connects to bore 60. A scallop 62, or other void, is formed in bore 60 and fluidly connects to an oil passage 64. A cross-passage 66 through rocker arm 48 connects to oil passage 64 and feeds oil to yet another oil passage formed in stud 52. Oil flow through the respective passages passes to a longitudinally extending oil passage 72 formed in pushrod 56, and in turn can flow to a pushrod seat on a valve lifter and into oil gallery 26. System 30 may include a plurality of pushrods each coupled to one of a plurality of valve lifters operating as gas exchange valve lifters, and each of the plurality of pushrods having a longitudinally extending oil passage similar or identical to oil passage 72. A plurality of rocker arms in a plurality of rocker arm assemblies similar or identical to rocker arm assembly 46 are coupled to the plurality of pushrods, and each including a rocker arm oil passage formed therein and fluidly connecting to the respective longitudinally extending oil passage in one of the plurality of push rods.

Figure 3:
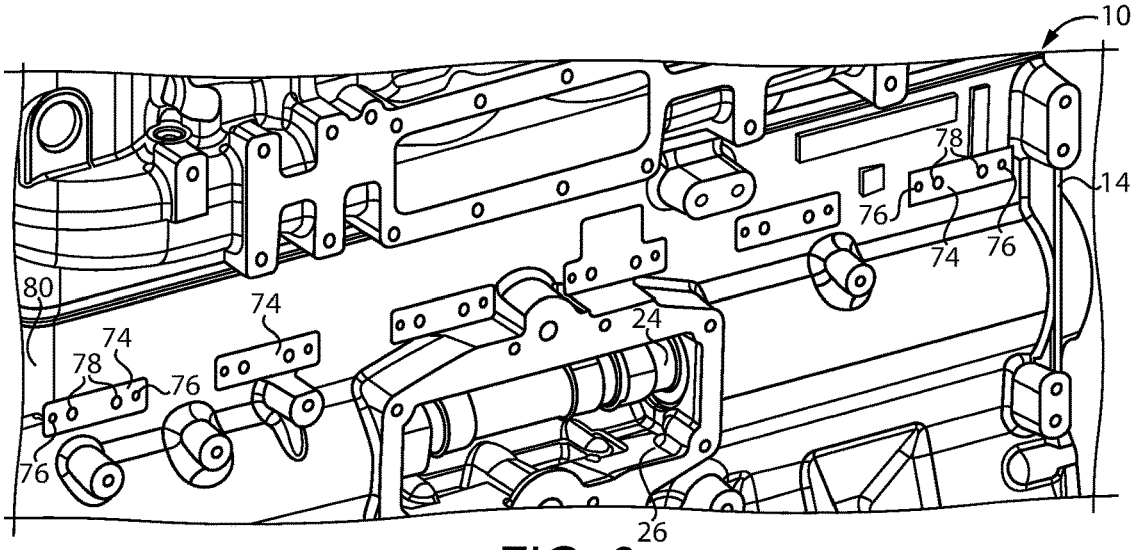
FIG. 3 is a diagrammatic view of a portion of the engine system as in FIG. 1.

Referring also now to FIG. 3, there are shown additional features of engine housing 12 including cylinder block 16. Cylinder block 16 may include a plurality of machined mounting surfaces 74 at spaced locations corresponding approximately to cylinders in engine 12. Each machined mounting surface 74 may be substantially planar and has formed therein a plurality of fastener holes 76 and a plurality of ports 78. An as-cast surface 80 extends around machined mounting surfaces 74.

Figure 4:
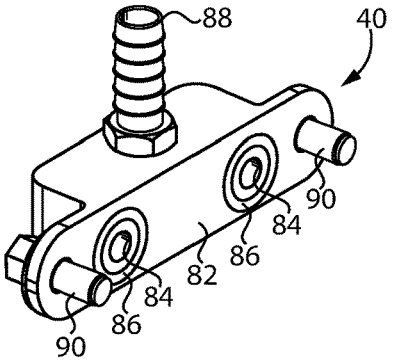
FIG. 4 is a diagrammatic view of a lifter manifold, according to one embodiment.

Referring also to FIG. 4, there are shown additional features of an example one of lifter manifolds 40. Lifter manifold 40 may include a substantially planer mounting face 82 and two fluid outlets 84 formed therein for supplying control fluid to each of two valve lifters associated with one cylinder, and a common fluid inlet formed by an inlet fitting 88. A control fluid, typically engine oil, flows via fitting 88 to fluid outlets 84. A pressure of the control fluid can thenceforth be supplied to the two associated valve lifters. A seal 86, such as a conventional O-ring seal, extends around each of fluid outlets 84. It can thus be appreciated that fasteners 90 can be received in fastener holes 76 in cylinder block 16 to establish fluid connections between fluid outlets 84 and ports 78.

Figure 5:
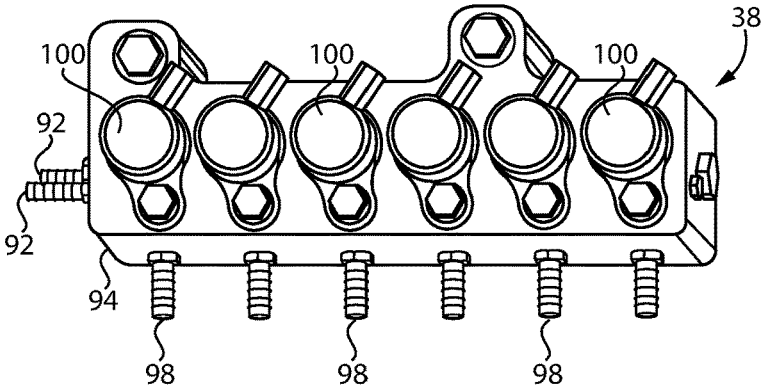
FIG. 5 is a diagrammatic view of a manifold assembly, according to one embodiment.

Referring also now to FIG. 5, there are shown additional features of manifold assembly 38. Manifold assembly 38 includes a plurality of fluid outlets 98 each structured to fluidly connect to one of the common fluid inlets 88 of lifter manifolds 40. Manifold assembly 38 also includes a valve body 94, and two fittings 92 structured to fluidly connect via fluid lines to oil gallery 26. A plurality of electrically actuated control valves 100 are positioned at least partially within valve body 94 and operate to selectively provide fluid connection between fittings 92 and fittings 98. Control valves 100 may be of a known off-the-shelf design. Each respective control valve 100 can be actuated, such as energized, to provide a flow of control fluid to one of lifter manifolds 40 to simultaneous switch two valve lifters between an activated state and a deactivated state. In an embodiment, energizing each respective control valve 100 varies the pressure of control fluid, such as increasing the pressure, to simultaneously switch two valve lifters from an activated state to a deactivated state. In a deactivated state, the valve lifters do not transfer translational motion to the associated pushrod, such that the associated engine valves do not operate, as further discussed herein. It will further be appreciated that a number of valves 100 may be equal to a number of cylinders in engine 12, enabling any number of cylinders in engine 12 to be selectively activated or deactivated.

Figure 6:
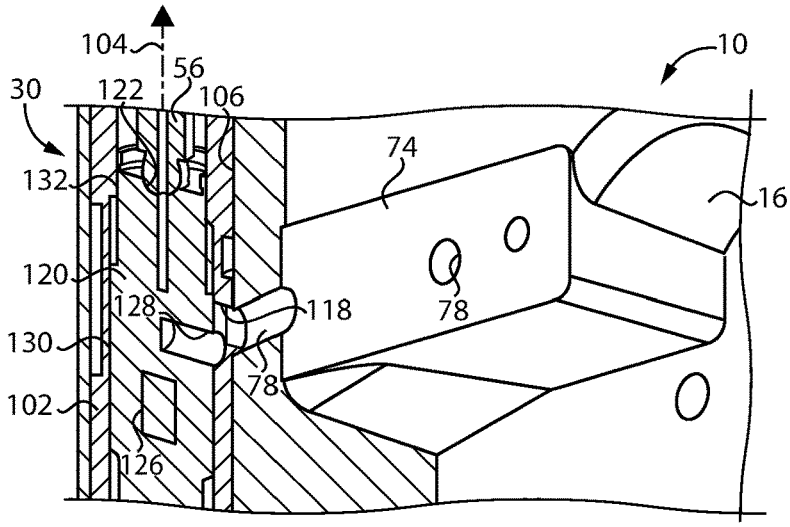
FIG. 6 is a sectioned diagrammatic view of a portion of the engine system as in FIG. 1.
Figure 7:
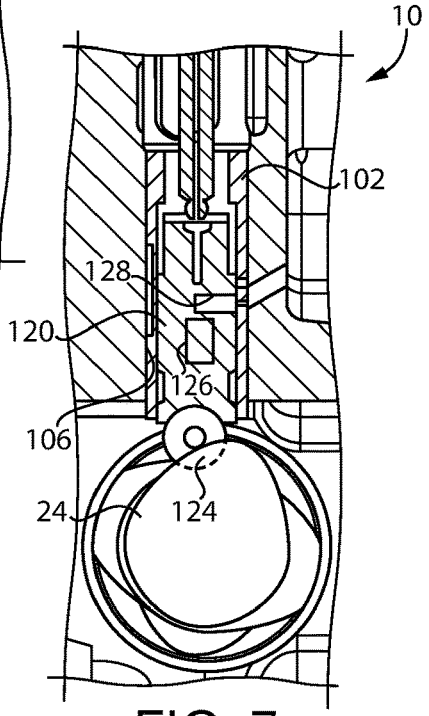
FIG. 7 is another sectioned side diagrammatic view of a portion of the engine system as in FIG. 1.

Referring also now to FIGS. 6 and 7, there is shown a valve lifter 120. Valve lifter 120 may be one of a plurality of interchangeable gas exchange valve lifters within a plurality of interchangeable lifter sleeves 102 in system 30, and the plurality of interchangeable gas exchange valve lifters being arranged in a plurality of exhaust-intake pairs. Lifter sleeve 102 defines a longitudinal axis 104 and is positionable in one of a plurality of lifter bores 106 in engine housing 14. Lifter sleeve 102 includes an inner sleeve surface 108 extending circumferentially around longitudinal axis 104 and forming a sleeve bore 110. FIG. 6 also illustrates port 78 extending through cylinder block 16 to lifter bore 106. A second valve lifter is hidden from view in FIG. 6 and will be understood as analogously constructed and arranged and fluidly connected to the second port 78 formed in machined mounting surface 74.

Figure 8:
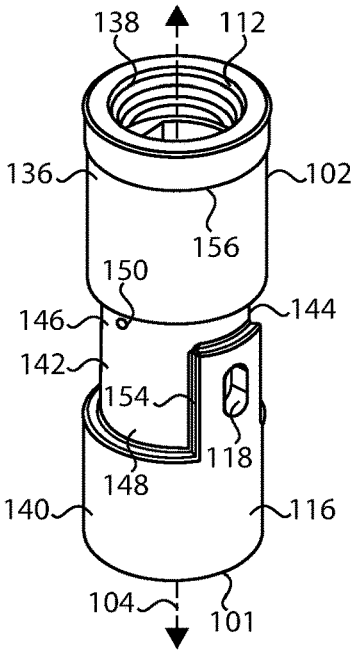
FIG. 8 is a diagrammatic view of a lifter sleeve, according to one embodiment.
Figure 9:
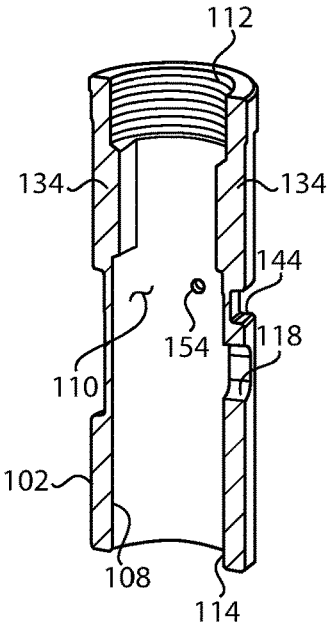
FIG. 9 is a sectioned diagrammatic view of a lifter sleeve, according to one embodiment.
Figure 10:
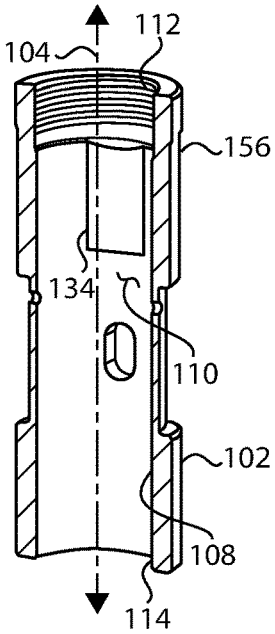
FIG. 10 is another sectioned diagrammatic view of a lifter sleeve, rotated from the viewpoint of FIG. 9.

Referring also to FIGS. 8, 9, and 10, lifter sleeve 102 includes an elongate sleeve body 101. Sleeve body 101 and lifter sleeve 102 are terms used herein, at times, interchangeably. Longitudinal axis 104 extends between an upper sleeve section 136 of lifter sleeve 102 forming a first axial end opening 112, and a lower sleeve section 140 forming a second axial end opening 114. Sleeve bore 110 extends between first axial end opening 112, and second axial end opening 114. An outer sleeve surface 116 extends circumferentially around longitudinal axis 104. Lifter sleeve 102 further includes a control fluid slot 118 formed therein and extending radially inward from outer sleeve surface 116 to inner sleeve surface 108. Valve lifter 120 is movable in an axial direction in sleeve bore 110 between a first position and a second position in response to rotation of camshaft 204. Valve lifter 120 is limited from rotating about longitudinal axis 104.

As can be seen from FIGS. 6 and 7, valve lifter 120 includes a pushrod seat 122 in contact with pushrod 56, and a lifter roller 124 in contact with a cam lobe on camshaft 24. Valve lifter 120 also includes a hydraulically actuated activation-deactivation switch 126, and a control fluid port 128 in fluid communication with control fluid slot 118 at each of the first position and the second position. It will thus be appropriated that as valve lifter 120 reciprocates in response to rotation of camshaft 24 control fluid port 128 remains continuously fluidly connected to control fluid slot 118. Valve lifter 120 and lifter sleeve 102 may each be one of a respective plurality of interchangeable parts, thus the present description will be understood to refer by way of analogy to other valve lifters and lifter sleeves in system 30.

Focusing now further on FIGS. 8-10, valve lifter 120 may include an outer lifter surface 130 forming an anti-rotation flat 132. A "flat" means a surface that is flat within measurement error. Other surfaces that are not strictly flat or planar could also be employed in limiting rotation, however. Inner sleeve surface 108 may include one or more valve lifter anti-rotation surfaces 152 within sleeve bore 110 in slidable contact with one or more anti-rotation flats 132. In the illustrated embodiment inner sleeve surface 108 includes two anti-rotation pads 134 positioned approximately in opposition to one another and each in slidable contact with outer lifter surface 130 to limit valve lifter 120 from rotating about longitudinal axis 104.

As also noted above, lifter sleeve 102 includes an upper sleeve section 136 forming first axial end opening 112. Upper sleeve section 136 may also include threads. In the illustrated embodiment the threads include internal threads 138 within sleeve bore 110. Lifter sleeve 102 may further include a necked-down middle sleeve section 142 forming a fluid flow annulus 144. Fluid flow annulus 144 extends circumferentially around longitudinal axis 104 at a location between upper sleeve section 136 and lower sleeve section 140. Necked-down middle sleeve section 142 may further be configured having a fully circumferential portion 146 forming fluid flow annulus 144, and a part circumferential portion 148 extending between fluid flow annulus 144 and lower sleeve section 140. Necked-down middle sleeve section 142 may further include a stepped-out wall 150 within part circumferential portion 148. Control fluid slot 118 may be formed in stepped-out wall 150.

As can best be seen from FIG. 8, control fluid slot 118 may be non-circular, having a major diameter or long dimension that extends in an axial direction relative to longitudinal axis 104. Control fluid slot 118 is further understood to include a minor diameter or shorter dimension extending in a tangential direction relative to longitudinal axis 104. Lifter sleeve 102 may further have one or more lubrication holes 154 formed therein and fluidly connecting between fluid flow annulus 144 and sleeve bore 110. A size of the one or more lubrication holes 154 may be less than a size of control fluid slot 118. Lifter sleeve 102 may further include within upper sleeve section 136 a locating stop 156 formed by outer sleeve surface 116 and projecting radially outward relative to longitudinal axis 104. In an implementation, locating stop 156 may include a locating chamfer that contacts cylinder block 16 as lifter sleeve 102 is installed in lifter bore 106 so as to install lifter sleeve 102 at a desired depth for receiving a flow of control fluid.

Figure 11:
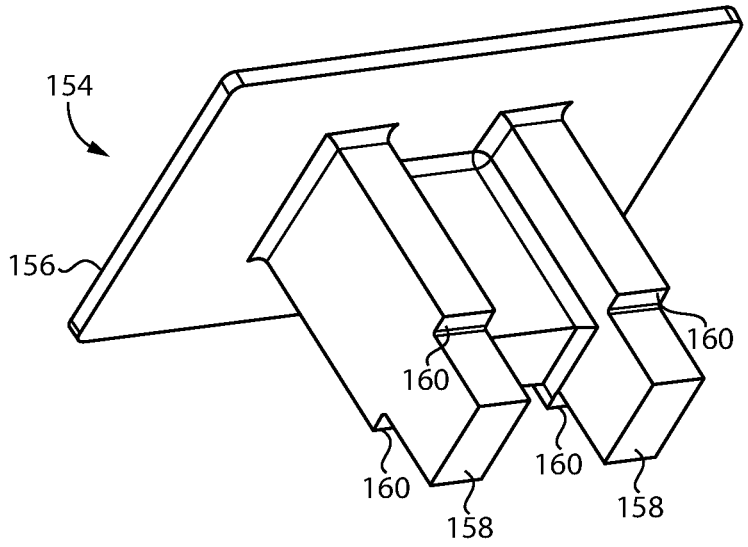
FIG. 11 is a diagrammatic view of an installation tool, according to one embodiment.

Turning now to FIG. 11, there is shown an installation tool 154 for installing two assemblies of a lifter sleeve and a valve lifter into an engine housing. Installation tool 154 may include a head or flange 156, and two arms 158 extending from flange 156. Each of arms 158 may include a plurality of stop surfaces 160. In an implementation, two lifter sleeves 102 associated with one exhaust-intake pair of valve lifters can be assembled onto arms 158. Two valve lifters 120 can then be assembled into the two lifter sleeves. An assembly of installation tool 154, two lifter sleeves, and two valve lifters can them be frozen in preparation for interference fit installation in two lifter bores. Stop surfaces 160 may be positioned in contact with the respective lifter sleeves. The assembly can then be taken from the freezer, the lifter bores coated with a suitable adhesive such as Loctite®, and the assembly installed into two lifter bores.

Figure 12:
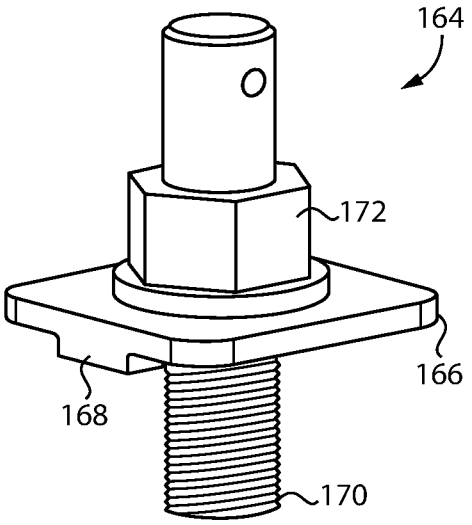
FIG. 12 is a diagrammatic view of a de-installation tool, according to one embodiment.

Turning to FIG. 12, there is shown a deinstallation tool 164 including a plate 166, having one or more tabs 168 formed thereon, a threaded shaft 170 extending through plate 166, and a nut 172. For deinstalling a lifter sleeve tool 164 can be positioned such that shaft 170 extends into first axial end opening 112 and threadedly engaged with threads 138. Nut 172 can then be rotated to withdraw the subject lifter sleeve out of the lifter bore, with plate 166 bearing against the cylinder block, and breaking the adhesive and interference fit of the sleeve. Tabs 168 can interfere with the cylinder block to prevent rotation of plate 166 during use.

INDUSTRIAL APPLICABILITY

Referring to the drawings generally, operating system 30 can include reciprocating a plurality of valve lifters 120 each between a first position and a second position in a plurality of lifter sleeves 102 in a plurality of lifter bores 106 in engine housing 12. A control fluid port 128 in each one of the valve lifters 120 is continuously fluidly connected to a control fluid slot 118 formed in each respective one of lifter sleeves 102 at each of the first position and the second position of the respective valve lifter. When it is desirable to activate or deactivate one or more of the valve lifters, a pressure of control fluid supplied through engine housing 14 to the control fluid slot in each lifter sleeve receiving a valve lifter can be varied as discussed herein. It is contemplated that an increase in a pressure of control fluid can be used to switch the respective activation-deactivation switches 126 off, and a reduced fluid pressure used to switch 126 on. The present discourse is not thereby limited, however. Based on varying a pressure of control fluid, one or more of the valve lifters, and typically both an exhaust valve lifter and an intake valve lifter in an exhaust-intake pair can be turned on or turned off simultaneously.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. An engine valve actuation system comprising:

a lifter sleeve defining a longitudinal axis and positionable in a lifter bore in an engine housing, the lifter sleeve including an inner sleeve surface extending circumferentially around the longitudinal axis and forming a sleeve bore extending between a first axial end opening and a second axial end opening, and an outer sleeve surface extending circumferentially around the longitudinal axis;

the lifter sleeve further including a control fluid slot formed therein and extending radially inward from the outer sleeve surface to the inner sleeve surface; and a valve lifter movable in an axial direction in the sleeve bore between a first position and a second position, and limited from rotating about the longitudinal axis, and the valve lifter including a pushrod seat, a lifter roller, a hydraulically actuated activation-deactivation switch, and a control fluid port fluidly connected to the control fluid slot at each of the first position and the second position.

2. The system of claim 1 wherein the valve lifter further includes an outer lifter surface forming an anti-rotation flat, and the inner sleeve surface including an anti-rotation pad in slidable contact with the anti-rotation flat.

3. The system of claim 1 wherein the lifter sleeve includes an upper sleeve section forming the first axial end opening and including internal threads within the sleeve bore, a lower sleeve section forming the second axial end opening, and a necked-down middle sleeve section forming a fluid flow annulus.

4. The system of claim 3 wherein the necked-down middle sleeve section includes a fully circumferential portion forming the fluid flow annulus, a part circumferential portion extending between the fluid flow annulus and the lower sleeve portion, and a stepped-out wall within the part circumferential portion, and the control fluid slot is formed in the stepped-out wall.

5. The system of claim 4 wherein the control fluid slot includes a major diameter extending in an axial direction, and a minor diameter extending in a tangential direction.

6. The system of claim 1 wherein the lifter sleeve is one of a plurality of lifter sleeves, and the valve lifter is one of a plurality of gas exchange valve lifters within the plurality of lifter sleeves and arranged in a plurality of exhaust-intake pairs.

7. The system of claim 6 further comprising:

a plurality of valve lifter manifolds each including two fluid outlets for supplying control fluid to each valve lifter in one of the plurality of exhaust-intake pairs, and a common fluid inlet; and a manifold assembly including a plurality of fluid outlets each structured to fluidly connect to one of the common fluid inlets, and a plurality of electrically actuated control valves each structured to vary a control fluid flow through one of the plurality of fluid outlets.

8. The system of claim 7 further comprising:

a plurality of pushrods each coupled to one of the plurality of gas exchange valve lifters, and having a longitudinally extending oil passage formed therein; and a plurality of rocker arms each coupled to one of the plurality of pushrods and each having a rocker arm oil passage formed therein and fluidly connected to the longitudinally extending oil passage in one of the plurality of pushrods.

9. An internal combustion engine including the valve actuation system of claim 7 and having an engine housing forming a plurality of lifter bores receiving the plurality of lifter sleeves, and a plurality of machined outer housing surfaces, and the plurality of valve lifter manifolds are attached to the plurality of machined outer housing surfaces.

10. A lifter sleeve for a valve lifter in an engine system comprising:

an elongate sleeve body defining a longitudinal axis extending between an upper sleeve section forming a first axial end opening, and a lower sleeve section forming a second axial end opening;

the elongate sleeve body further including an inner sleeve surface extending circumferentially around the longitudinal axis and forming a sleeve bore extending from the first axial end opening to the second axial end opening, and an outer sleeve surface extending circumferentially around the longitudinal axis;

the elongate sleeve body further including a fluid flow annulus extending circumferentially around the longitudinal axis at a location between the upper sleeve section and the lower sleeve section, and a control fluid slot extending from the outer sleeve surface to the inner sleeve surface; and the upper sleeve section further including threads, and a valve lifter anti-rotation surface within the sleeve bore and positioned axially inward of the threads.

11. The lifter sleeve of claim 10 wherein the threads include internal threads, and the elongate sleeve body further having a first anti-rotation pad including the valve lifter anti-rotation surface, and a second anti-rotation pad including a second valve lifter anti-rotation surface.

12. The lifter sleeve of claim 10 wherein the elongate sleeve body further has a lubrication hole formed therein and fluidly connecting between the fluid flow annulus and the sleeve bore, and a size of the lubrication hole is less than a size of the control fluid slot.

13. The lifter sleeve of claim 12 wherein the control fluid slot includes a major diameter extending in an axial direction, and a minor diameter extending in a tangential direction.

14. The lifter sleeve of claim 10 wherein the upper sleeve section includes a locating stop formed by the outer sleeve surface.

15. The lifter sleeve of claim 10 wherein the elongate sleeve body further includes a necked-down middle sleeve section forming the fluid flow annulus.

16. The lifter sleeve of claim 15 wherein:

the necked-down middle sleeve section includes a fully circumferential portion forming the fluid flow annulus, and a part circumferential portion extending between the fluid flow annulus and the lower sleeve end; and the necked-down middle section includes a stepped-out wall within the part circumferential portion, and the control fluid slot is formed in the stepped-out wall.

17. A method of operating an engine valve actuation system comprising:

reciprocating a plurality of valve lifters between a first position and a second position in a plurality of lifter sleeves in a plurality of lifter bores in an engine housing;

fluidly connecting a control fluid port in each one of the plurality of valve lifters to a control fluid slot formed in each respective one of the plurality of lifter sleeves at each of the first position and the second position;

varying a pressure of a control fluid supplied through the engine housing to the control fluid slot in at least one of the plurality of lifter sleeves; and switching a hydraulically actuated activation-deactivation switch in the valve lifter in the at least one of the plurality of lifter sleeves between an activated state and a deactivated state based on the varying a pressure of a control fluid.

18. The method of claim 17 further comprising varying the pressure of a control fluid supplied through the engine housing to control fluid slots in two lifter sleeves receiving two valve lifters in an exhaust-intake pair, and simultaneously switching the two valve lifters from the activated state to the deactivated state.

19. The method of claim 18 wherein the varying a pressure of a control fluid includes varying a pressure of a control fluid supplied to the control fluid slots in the two lifter sleeves from a common valve lifter manifold attached to the engine housing.

20. The method of claim 17 wherein the control fluid slot includes a major diameter extending in an axial direction, and a minor diameter extending in a tangential direction.

* * * * *